US006225600B1

(12) United States Patent
Burris

(10) Patent No.: US 6,225,600 B1
(45) Date of Patent: May 1, 2001

(54) SNOW MELTING DEVICE FOR GUTTERS

(76) Inventor: John J. Burris, 252 Essex Rd., Warminster, PA (US) 18974

( * ) Notice: Subject to any disclaimer, the term of this patent is extended or adjusted under 35 U.S.C. 154(b) by 0 days.

(21) Appl. No.: 08/728,974

(22) Filed: Oct. 11, 1996

(51) Int. Cl.[7] ..... H05B 1/00; H05B 3/44
(52) U.S. Cl. ..... 219/213; 219/544
(58) Field of Search ..... 219/213, 544, 219/546, 547, 548; 338/266, 267, 268, 269, 286, 287; 52/24, 11

(56) References Cited

U.S. PATENT DOCUMENTS

| | | | | |
|---|---|---|---|---|
| 2,507,039 | * | 5/1950 | Miller | 219/213 |
| 4,043,527 | * | 8/1977 | Franzmeier | 219/213 |
| 4,134,002 | * | 1/1979 | Stanford | 219/213 |
| 4,335,299 | * | 6/1982 | Belohlavek | 219/213 |
| 4,375,805 | * | 3/1983 | Weber | 219/213 |
| 4,401,880 | * | 8/1983 | Eizenhoefer | 219/213 |
| 4,419,567 | * | 12/1983 | Murphy et al. | 219/523 |
| 4,419,569 | * | 12/1983 | Colten | 219/549 |
| 5,111,032 | * | 5/1992 | Batliwalla et al. | 219/544 |
| 5,315,090 | * | 5/1994 | Lowenthal | 219/213 |
| 5,391,858 | * | 2/1995 | Tourangeau et al. | 219/213 |

FOREIGN PATENT DOCUMENTS

| | | | | |
|---|---|---|---|---|
| 980986 | * | 1/1965 | (GB) | 219/213 |

OTHER PUBLICATIONS

Chromalox Thermowire Bulletin 1000, undated.*

* cited by examiner

*Primary Examiner*—Sang Paik

(57) ABSTRACT

A snow melting device for gutters including a snow melting strip positionable within a closed lower end of a gutter. The snow melting strip will serve to melt accumulated snow upon activation to allow proper drainage of water through downspouts of the gutter.

1 Claim, 3 Drawing Sheets

SNOW MELTING DEVICE FOR GUTTERS

BACKGROUND OF THE INVENTION

1. Field of the Invention

The present invention relates to a snow melting device for gutters and more particularly pertains to preventing snow build-up in gutters with a snow melting device for gutters.

2. Description of the Prior Art

The use of snow melting devices is known in the prior art. More specifically, snow melting devices heretofore devised and utilized for the purpose of melting accumulated snow are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,043,527 to Franzmeier discloses heating cables.

U.S. Pat. No. 5,315,090 to Lowenthal discloses an awning gutter.

U.S. Pat. No. 4,401,880 to Eizenhoefer discloses a device to melt ice and snow on a roof structure.

U.S. Pat. No. 4,375,805 to Weber discloses a solar roof, eaves and gutter device.

U.S. Pat. No. 4,134,002 to Stanford discloses down spouts provided with heated elements.

U.S. Pat. No. 5,391,858 to Tourangeau et al. discloses an ice dam melting system.

While these devices fulfill their respective, particular objective and requirements, the aforementioned patents do not describe a snow melting device for gutters for preventing snow build-up in gutters.

In this respect, the snow melting device for gutters according to the present invention substantially departs from the conventional concepts and designs of the prior art, and in doing so provides an apparatus primarily developed for the purpose of preventing snow build-up in gutters.

Therefore, it can be appreciated that there exists a continuing need for new and improved snow melting device for gutters which can be used for preventing snow build-up in gutters. In this regard, the present invention substantially fulfills this need.

SUMMARY OF THE INVENTION

In the view of the foregoing disadvantages inherent in the known types of snow melting devices now present in the prior art, the present invention provides an improved snow melting device for gutters. As such, the general purpose of the present invention, which will be described subsequently in greater detail, is to provide a new and improved snow melting device for gutters and method which has all the advantages of the prior art and none of the disadvantages.

To attain this, the present invention essentially comprises a gutter of a predetermined length secured to a house at a lower end of a roof thereof. The gutter has a rear wall secured to the house. The gutter has an open upper end, a closed lower end and a curved front wall. The curved front wall extends to a length equal to a length of the rear wall. The device includes a snow melting strip comprised of an elongated generally rectangular waterproof housing of a predetermined length. The housing has a heating coil extending lengthwise therethrough in a zigzag configuration. The housing is positionable within the closed lower end of the gutter. The snow melting strip has a thickness less than twenty percent of a depth of the gutter. An adjustable switch is secured within the house. The adjustable switch cooperates with the snow melting strip for activation and temperature control thereof.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved snow melting device for gutters which has all the advantages of the prior art snow melting devices and none of the disadvantages.

It is another object of the present invention to provide a new and improved snow melting device for gutters which may be easily and efficiently manufactured and marketed.

It is a further object of the present invention to provide a new and improved snow melting device for gutters which is of durable and reliable construction.

An even further object of the present invention is to provide a new and improved snow melting device for gutters which is susceptible of a low cost of manufacture with regard to both materials and labor, and which accordingly is then susceptible of low prices of sale to the consuming public, thereby making such a snow melting device for gutters economically available to the buying public.

Even still another object of the present invention is to provide a new and improved snow melting device for gutters for preventing snow build-up in gutters.

Lastly, it is an object of the present invention to provide a new and improved snow melting device for gutters including a snow melting strip positionable within a closed lower end of a gutter. The snow melting strip will serve to melt accumulated snow upon activation to allow proper drainage of water through downspouts of the gutter.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
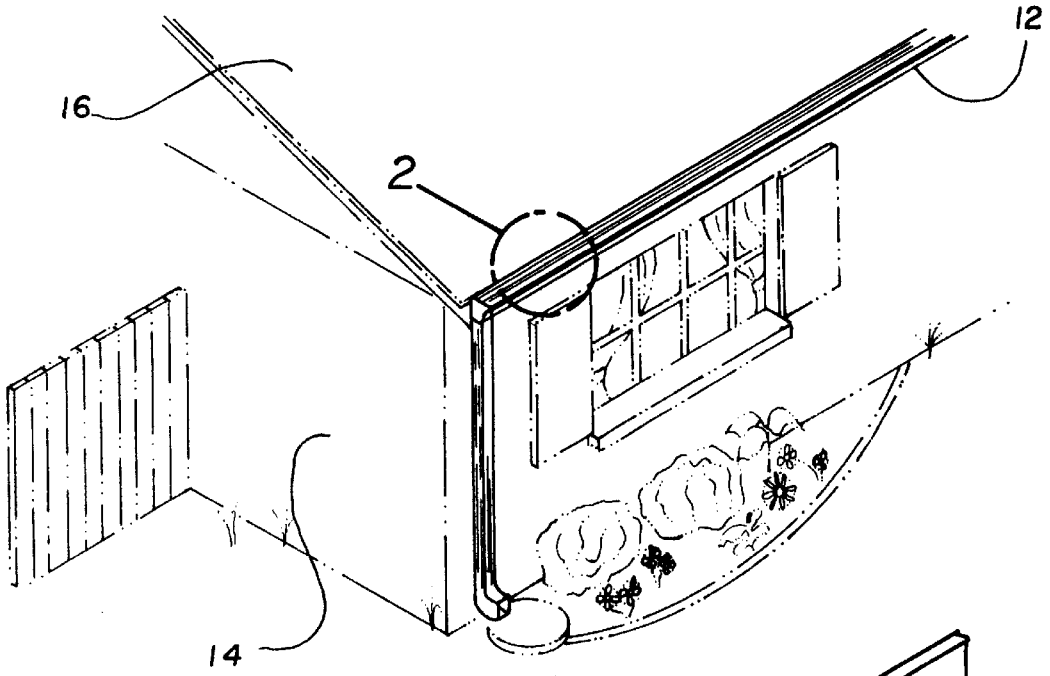
FIG. 1 is a perspective view of the preferred embodiment of the snow melting device for gutters constructed in accordance with the principles of the present invention.
Figure 2:
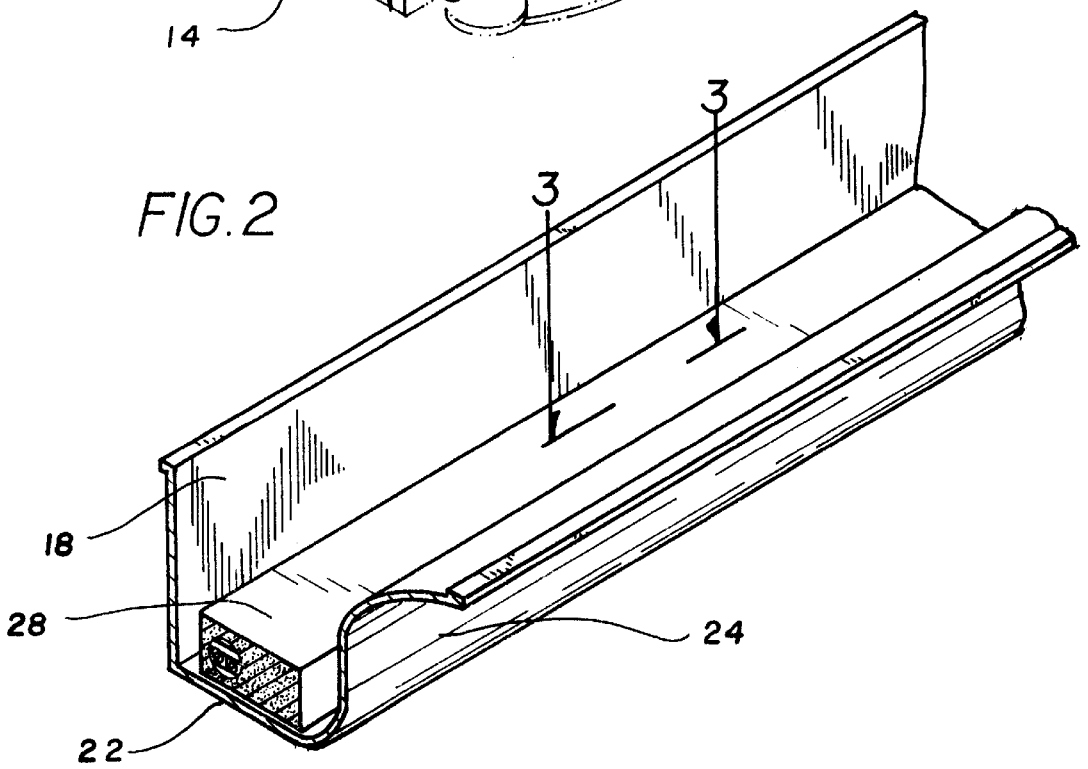
FIG. 2 is perspective view of the present invention in place within a gutter.
Figure 3:
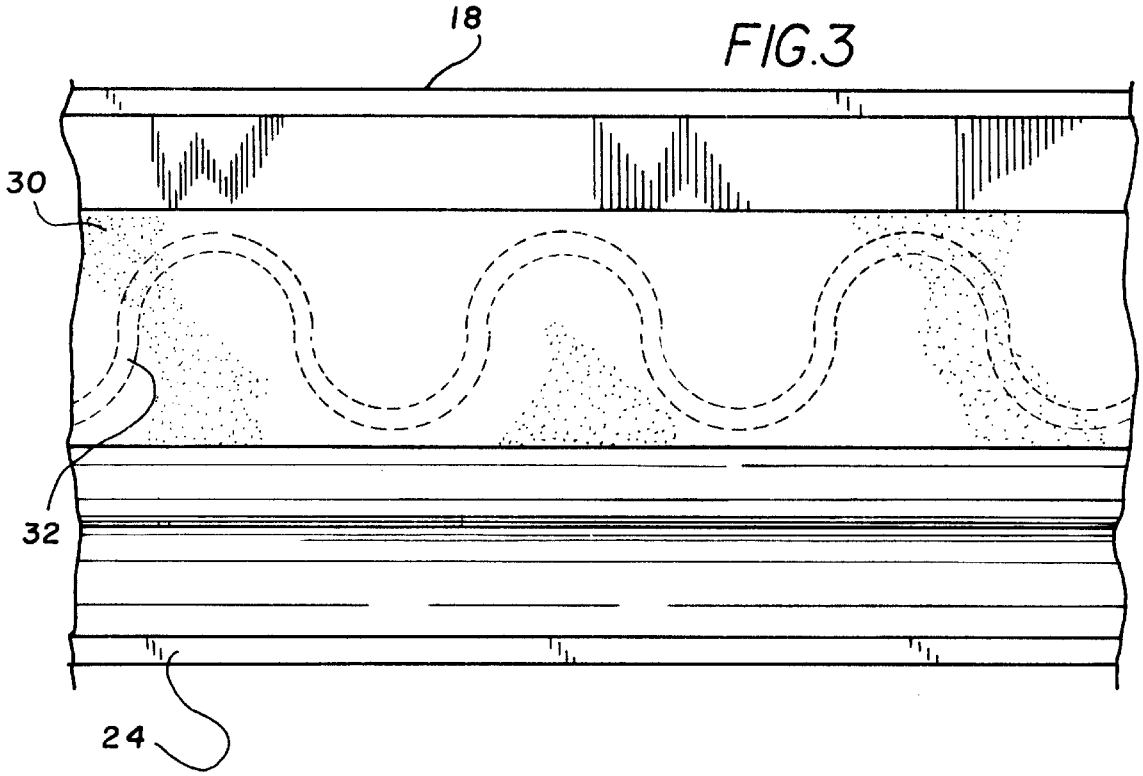
FIG. 3 is a cross-sectional view as taken along line 3—3 of FIG. 2.
Figure 4:
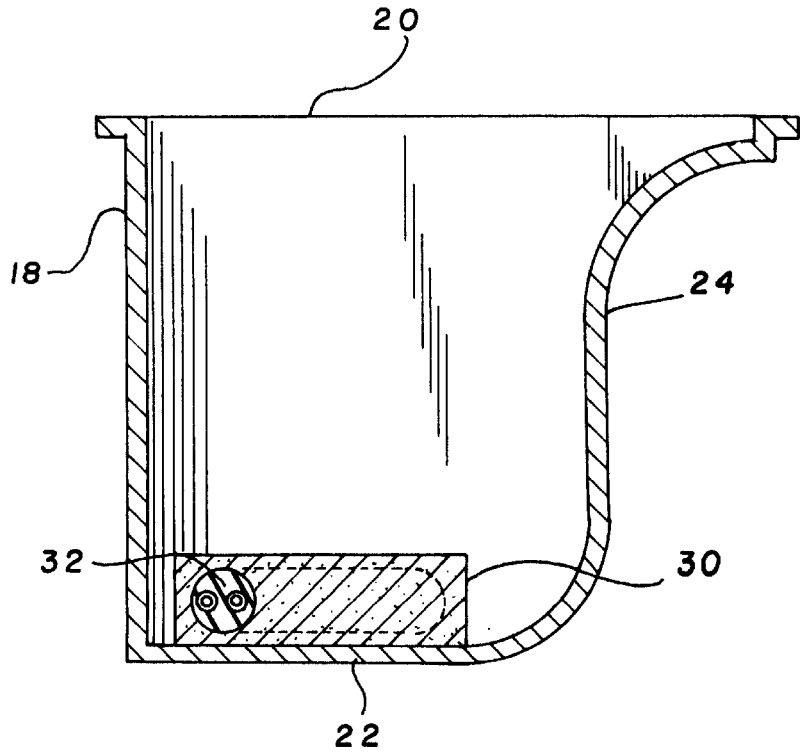
FIG. 4 is a side view of the present invention in place within the gutter.
Figure 5:
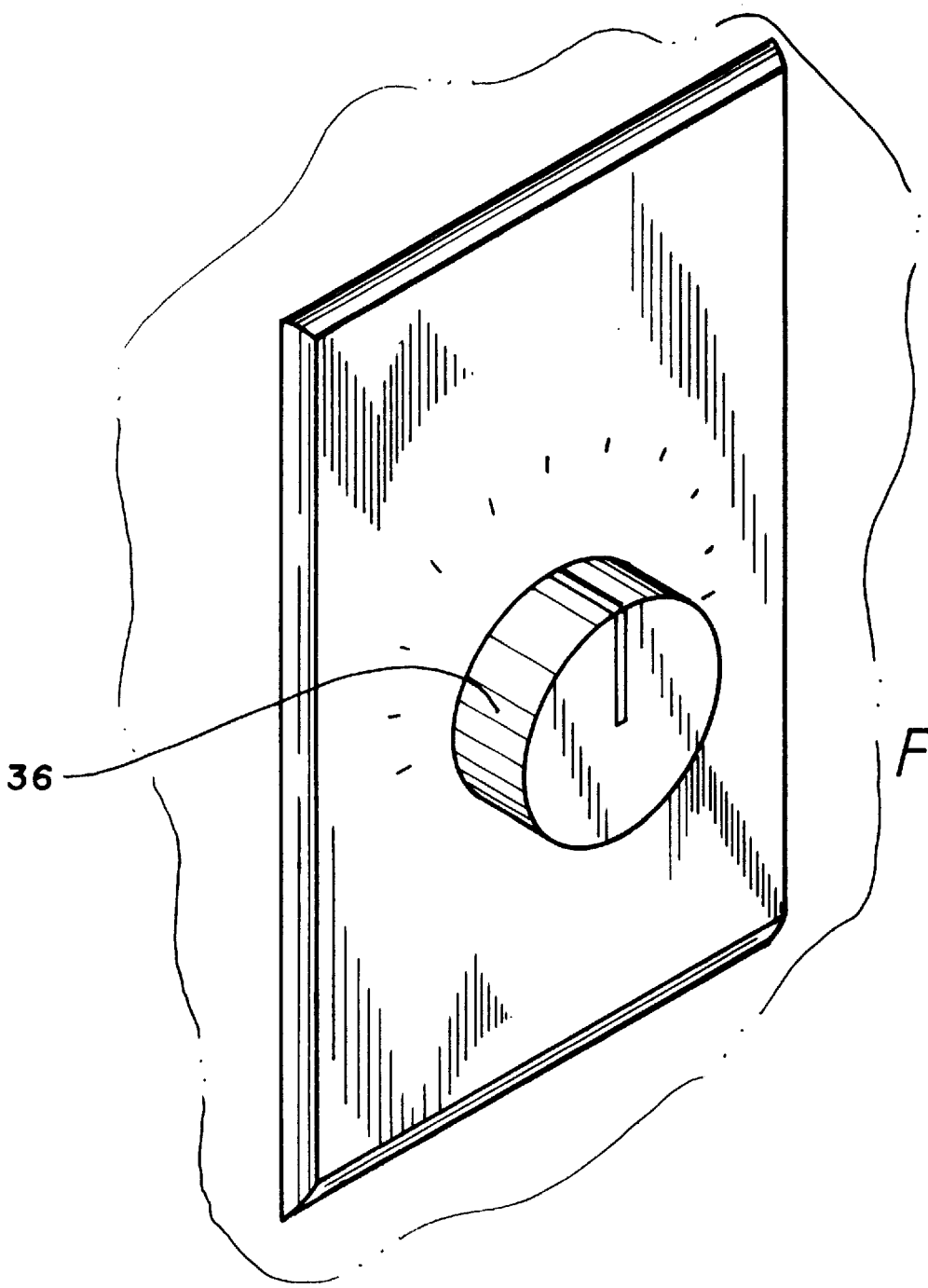
FIG. 5 is a perspective view of the adjustable switch of the present invention.

With reference now to the drawings, and in particular, to FIGS. 1–5 thereof, the preferred embodiment of the new and improved snow melting device for gutters embodying the principles and concepts of the present invention and generally designated by the reference number 10 will be described.

Specifically, it will be noted in the various Figures that the device relates to a snow melting device for gutters for preventing snow build-up in gutters. In its broadest context, the device consists of a gutter, a snow melting strip and an adjustable switch. Such components are individually configured and correlated with respect to each other so as to attain the desired objective.

The device 10 includes a gutter 12 of a predetermined length secured to a house 14 at a lower end of a roof 16 thereof. Note FIG. 1. The gutter 12 has a rear wall 18 secured to the house 14. The gutter 12 has an open upper end 20, a closed lower end 22 and a curved front wall 24. The curved front wall 24 extends to a length equal to a length of the rear wall 18.

The device 10 includes a snow melting strip 28 comprised of an elongated generally rectangular waterproof housing 30 of a predetermined length. The housing 30 is preferably fabricated of a flexible material such as rubber or vinyl or a synthetic blend. The housing 30 has a heating coil 32 extending lengthwise therethrough in a zigzag configuration. The heating coil 32 is positioned centrally between upper and lower surfaces of the housing 30. The housing 30 is positionable within the closed lower end 22 of the gutter 12. The snow melting strip 28 has a thickness less than twenty percent of a depth of the gutter 12. This enables the positioning of the snow melting strip 28 within the gutter 12 and still allowing for the gutter to gather debris. The snow melting strip 28 has a thickness less than a thickness of the gutter 12, thus enabling melted snow to dissipate through a downspout of the gutter 12. The length of the snow melting strips 28 will vary to accommodate a variety of lengths of gutters 12.

An adjustable switch 36 is secured within the house 14. The adjustable switch 36 cooperates with the snow melting strip 28 for activation and temperature control thereof. The activation switch 36 will be placed within the house 14 in a position accessible to a user to activate the device 10 when snow fall is occurring.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A snow melting device for gutters for preventing snow build-up in gutters comprising, in combination:

a gutter of a predetermined length secured to a house at a lower end of a roof thereof, the gutter having a rear wall secured to the house, the gutter having an open upper end, a closed lower end with a flat surface over the majority of its extent adjacent to the rear wall and a curved surface laterally offset therefrom remote from the rear wall and a curved front wall, the curved front wall extending to a length equal to a length of the rear wall;

a snow melting strip comprised of an elongated generally rectangular waterproof housing of a predetermined length, the housing having a single heating coil extending lengthwise therethrough in a zigzag configuration, the heating coil positioned centrally between the upper and lower surface of the housing, the housing positionable within the closed lower end of the gutter, the snow melting strip covering only the entire flat surface of the gutter but having the curved surface of the gutter uncovered to allow the flow of melted snow across the strip and to one side of the strip, the strip having a thickness of about twenty percent of a depth of the gutter where about eighty percent of the gutter is capable of collecting debris other than snow and ice within therein; and an adjustable switch secured within the house, the adjustable switch cooperating with the snow melting switch for activation and temperature control thereof.

* * * * *